United States Patent [19]

Dickey

[11] 4,161,313

[45] Jul. 17, 1979

[54] PRACTICE DEVICE FOR BASKETBALL

[76] Inventor: Russell F. Dickey, 3618 Lakeshore Dr., Smyrna, Ga. 30080

[21] Appl. No.: 859,399

[22] Filed: Dec. 12, 1977

[51] Int. Cl.[2] ..... A63B 69/00

[52] U.S. Cl. ..... 273/1.5 A; 46/DIG. 1; 46/242; 273/DIG. 30

[58] Field of Search ..... 273/1.5 R, 1.5 A, 26 E, 273/29 A, DIG. 30; 46/DIG. 1, 242

[56] References Cited

U.S. PATENT DOCUMENTS

| | | | |
|---|---|---|---|
| 2,939,705 | 6/1960 | McCall, Jr. | 273/1.5 A |
| 3,023,001 | 2/1962 | Goordouze | 273/1.5 A |
| 3,204,957 | 9/1965 | Logue | 273/1.5 A |
| 3,397,885 | 8/1968 | Nash, Jr. | 46/242 X |
| 3,893,669 | 7/1975 | Myers | 273/29 A |
| 3,940,132 | 2/1976 | Lopatto | 273/26 E X |
| 3,999,753 | 12/1976 | Desilets et al. | 273/29 A |

*Primary Examiner*—Paul E. Shapiro

*Attorney, Agent, or Firm*—James B. Middleton

[57] ABSTRACT

A basketball practice device to allow a player to practice handling a basketball in rebounding and tipping, the device including a boom pivoted above a backboard, an extendible section depending from the boom in the vicinity of the goal on the backboard, and a cap for releasably holding a basketball carried at the lower end of the extendible section, the attachment by which the basketball is held to the cap being variable to vary the ease with which the ball is removed from the cap.

4 Claims, 4 Drawing Figures

PRACTICE DEVICE FOR BASKETBALL

This invention relates generally to sports practice devices, and is more particularly concerned with apparatus to assist in the practice of basketball.

In playing the game of basketball, the ultimate object is to cause the basketball to go through the goal. In order to accomplish this, however, there are certain techniques that should be mastered by the players. One important technique in the game of basketball is the handling of the ball that rebounds from the backboard. When a player on one's own team attempts to throw the ball through the goal, and the ball hits the backboard and bounces, but does not go through the goal, one should be able to retrieve the ball and cause the ball to go through the goal. On the other hand, when a player on the opposing team attempts to throw the ball through the goal, and the ball bounces off the backboard and does not go through the goal, one should take the ball so that his team can attempt to score. Another important technique in the game of basketball is the tipping of a ball through the goal. This technique is used when one's team member attempts to throw the ball through the goal, and there is a near miss. In this situation, a player can frequently use just the tip of his fingers and urge the ball in the appropriate direction for the ball to fall through the goal. Since both rebounding and tipping are techniques in placing the ball through the goal, these are very important techniques and should be learned well by every player.

The learning or rebounding and tipping is difficult for a player because a player cannot practice unless he can place a basketball in the appropriate position for him to be able to handle the ball as appropriate. Such placement of a basketball is generally completely accidental in the course of a basketball game so that one is faced with the problem of intentionally creating a situation that normally occurs only by accident.

In the past, one method that has been used for players to practice tipping and rebounding is for the coach or some other person to throw a basketball against the backboard and allow one or more players to attempt to handle the ball as appropriate. The biggest problem with this method is that only a small percentage of the total number of throws will place the ball in a position for the players to have any desirable form of practice. As a result, a large amount of time is spent in throwing the ball to achieve only a small amount of practice by the players. Another attempt to solve the problem of practice has been the provision of a device for holding a plurality of basketballs, one basketball being placed so that it can be grasped and removed by a player's jumping and grabbing the ball. Once the first ball is removed, a mechanism allows a second ball to take its place and the practice is repeated. In this device, however, there is no backboard and no goal, so that the player's only practice is that of jumping and grabbing a ball. While this is a valuable feat in the game of basketball, this form of practice is an isolated feat and cannot teach a player the complete skill—to grab a ball and place it through a goal. Further, the device has no provision to allow any form of practice with respect to tipping. Other basketball practice devices have included apparatus wherein a basketball is suspended in the vicinity of a backboard and goal; however, these devices have placed the ball permanently on a tether, and such devices have been so arranged that the only form of practice is for a player to attempt to throw the ball through the goal. The ball remains on the tether, which of course distorts the normal action of a ball and apparently serves little purpose other than to obviate the necessity for chasing the ball after an attempt at making a goal.

The present invention overcomes the above mentioned and other difficulties with the prior art apparatus by providing holding means for releasably holding a basketball adjacent to a backboard having a goal thereon. Said holding means is selectively placeable in various positions adjacent to the backboard to allow one to simulate virtually any condition in the game of basketball, the holding means being adjustable in both a horizontal plane and a vertical plane. In more detail, the apparatus of the present invention includes a boom positioned adjacent to a backboard, an extendible section depending from the end of the boom, and a cap including attaching means to releasably attach the ball to the cap. Thus, the boom can be moved in a horizontal plane for variable positioning of the basketball in a horizontal plane; and, the extendible section allows the basketball to be moved in a vertical plane so the ball can be placed at virtually any position desired. Furthermore the attaching means may be adjustable so that the ease with which the basketball is released is variable. With such adjustability, the device can be adjusted so that a player must grasp the ball with both hands in order to cause the ball to be released, or the device can be adjusted so that a player may simply tip the ball and cause it to be released.

These and other features and advantages of the present invention will become apparent from consideration of the following specification when taken in conjunction with the accompanying drawing in which.

Figure 1:
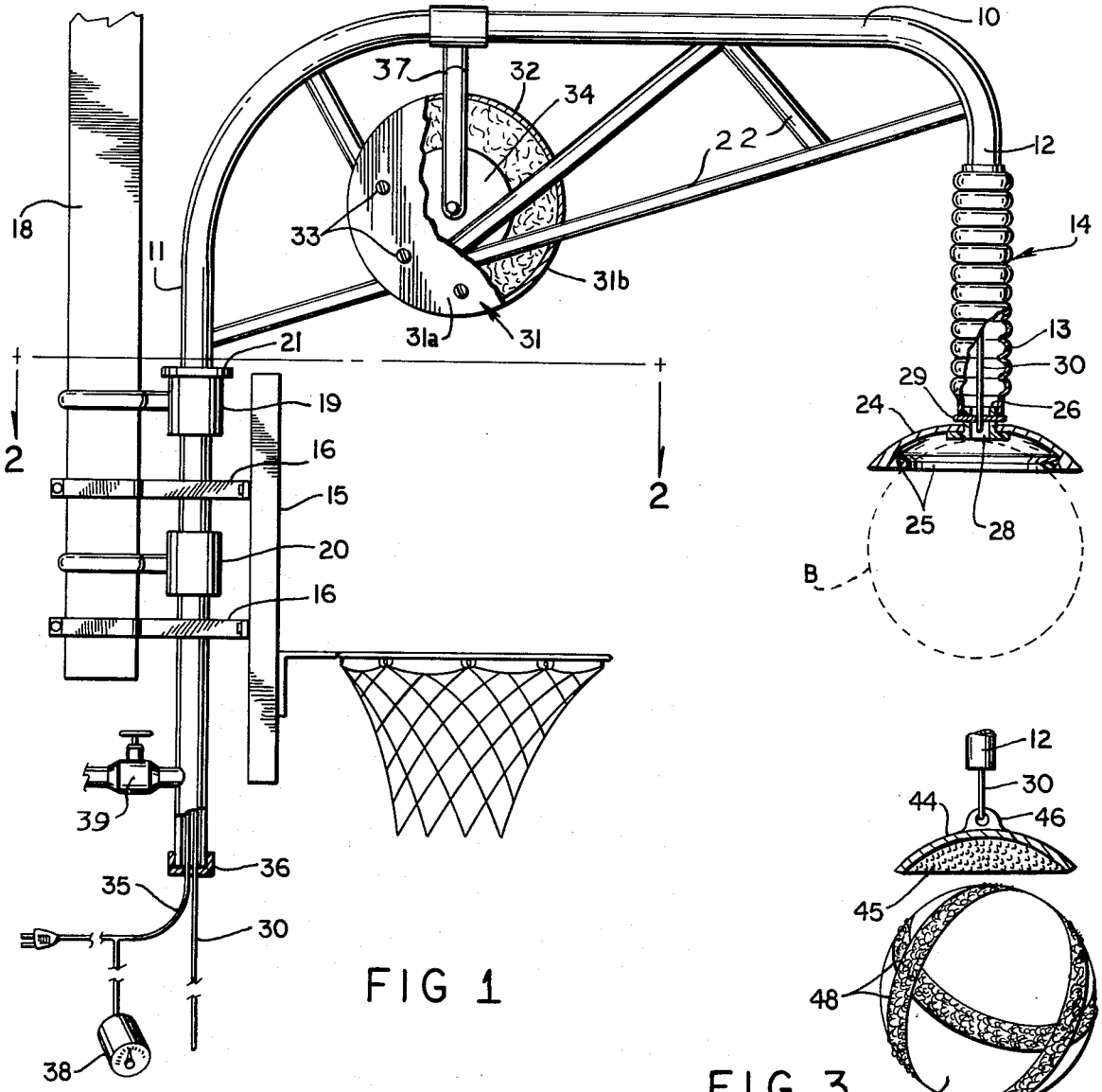
FIG. 1 is a side elevational view of one form of practice device made in accordance with the present invention, the device being partially in cross-section to show the construction of the apparatus.

Referring now more particularly to the drawing, and to those embodiments of the invention here chosen by way of illustration, it will be seen in FIG. 1 that the apparatus of the present invention includes a boom 10, here shown as supported from a vertical post formed integrally therewith. The extending end of the boom turns down as at 12 to provide for connection of the extendible section 14.

Though it will be understood by those skilled in the art that the apparatus of the present invention can be adapted for mounting adjacent to any basketball backboard, the arrangement here illustrated includes a backboard 15 mounted by appropriate supports 16 from a standard 18. The vertical post 11 is held between the standard 18 and the backboard 15 by being received in sleeves 19 and 20, the sleeves 19 and 20 being in turn supported by U-bolts or the like from the standard 18.

It should be understood that the vertical post 11 is preferably round, and the sleeves 19 and 20 are round so that the vertical post 11 is pivotal within the sleeves 19 and 20. To hold a selected vertical position of the post 11, there is a washer 21 fixed to the post 11 immediately above the upper sleeve 19. The washer 21 acts as a bearing surface limiting downward motion of the post 11 while allowing rotation of the post with respect to the sleeves 19 and 20.

To provide the necessary rigidity, there are struts 22 fixed to the boom 10, post 11, and the down-turned portion 12. It will be understood that the struts 22 may vary as required, depending on the size, weight, and other loading on the boom 10. At the lowermost end of the down-turned portion 12, the extendible section 14 is connected, the extendible section 14 being here shown as including an elastic hose 13 having corrugations or the like so that the hose 13 can extend to a considerable length or can be drawn together to a rather short length. Carried at the lowermost end of the extendible section 14 is a cap 24 which is adapted for holding a basketball B.

It should here be noted that the term "cap" is intended to refer to the device to which the basketball adheres, even though in some embodiments of the invention the device may have little resemblance to a cap in the usual sense of the word.

Referring again to FIG. 1 of the drawing, it will be seen that the cap 24 is shaped to receive a segment of the basketball B therein, and preferably to leave some space between the ball B and the interior of the cap 24. Around the periphery of the cap 24, there is a sealing strip 25 arranged so that the ball B will be contacted by the strip 25 and provide a hermetic seal for the interior of the cap 24 when the ball B is fully engaged with the cap 24.

The cap 24 is provided with an upstanding collar 26 to which the hose 13 is connected and sealed. The collar 26 has a central opening 28 that communicates with the interior of the cap 24 and with the interior of the hose 13. Also, the collar 26 includes a pin 29 substantially diametrically thereof for attachment of the cable 30. As will be seen more fully hereinafter, the cable 30 is the control means to determine the vertical position of the cap 24.

Carried by the boom 10, there is a housing 31 containing a vacuum pump with its associated motor 34. The vacuum pump is arranged with its low pressure side in communication with the interior of the boom 10 so that the interior is evacuated. It should be understood that the boom 10, the down-turned portion 12, and the post 11 are integrally formed of a single piece of pipe in the present embodiment of the invention, so the entire pipe is evacuated. Thus, the hose 13 of the extendible section 14 is also evacuated; and, since the hose 13 is in communication with the cap 24, the interior of the cap 24 will be evacuated.

Though many particular arrangements may be used as a means to evacuate the pipe comprising the post 11, boom 10 and the extendible section 14, the construction here shown is convenient and renders the apparatus unitary. Obviously, external vacuum sources could be used, or a vacuum pump could be differently arranged, and such variations are considered to be within the scope of the present invention. Nevertheless, looking at the housing 31 in FIG. 1 of the drawing it will be seen that the housing includes two dish-shaped sections 31*a* and 31*b*, each section being on one side of the struts 22 for the boom 10. The sections 31*a* and 31*b* therefore sandwich the struts therebetween so that bolts 33 hold the two sections together and hold the housing 31 in place. The vacuum pump and motor 34 are arranged to rest on the struts 22 as indicated, so the struts 22 directly carry the weight.

Within the housing 31 there is insulation indicated at 32 packed around the vacuum pump and motor 34 to deaden the noise generated. The housing 31 should be sufficiently large in relation to the pump and motor 34 to allow enough sound insulation 32 for the required quietness of the apparatus.

The intake, or suction, side of the pump is connected, by pipe 37, to the boom 10 so that the pump evacuates the interior of the boom 10 as described hereinabove. The exhaust side of the pump can simply be open to the atmosphere.

The cable 30, which is fixed to the pin 29 in the collar 26, runs up through the hose 13 and continues through the down-turned section 12, the boom 10 and the post 11, to emerge at the lowermost end of the post 11. Thus, by releasing the cable 30, the weight of the cap 24 will cause the extendible section 14 to elongate and allow the cap 24 to move down. Conversely, by pulling the cable 30 the cap 24 will be lifted, thereby shortening the extendible section 14 as required for the desired placement of the cap 24.

As here shown, the electric power cord 35 may also pass through the boom 10 and pipe 11 from the vacuum pump and motor 34. Appropriate metallic sheathing can be provided for protection of the electrical wires form the cable 30. At the lowermost end of the pipe 11 there is a cap 36 having a pair of openings as appropriate for the cable 30 and the electrical cord 35. As here contemplated, the cap 36 is made of a relatively yieldable material such as a polyvinyl chloride, nylon or the like. Such material provides a sufficient engagement with the cord and the cable 30 so that no further sealing is required to maintain the desired vacuum within the pipe 11.

The cord 35 emerges from the pipe 11 and is provided with a cord for connection to a source of electrical power as indicated by the conventional plug 37. A branch from the cord 35 leads to a rheostat 38.

The pipe 11 is illustrated as including a valve 39 toopen the pipe 11 to the atmosphere. Such a valve may or may not be used in the apparatus, the purpose of the valve 39 being to reduce the amount of the vacuum by admitting outside air. This arrangement may be used in lieu of the rheostat 38 and may sometimes be used in addition to the rheostat 38.

It will be recognized by those skilled in the art that some air must always enter the system to prevent overloading the motor for the vacuum pump. Normally there will be enough leakage in a system to prevent damage to the pump and motor 34; but, if the system is otherwise too well sealed, a valve such as the valve 39 could provide the necessary leakage.

At this point, it should be understood that the electrical cord 35 is connected to an appropriate source of electrical power which caused operation of the vacuum pump and motor 34, and the vacuum pump tends to evacuate the interior of the device, including the interior of the cap 24. As a result, when a basketball B is placed against the sealing strip 25 in the cap 24, the atmospheric pressure acting against the basketball B will retain the ball against the cap 24 due to the low pressure within the cap 24. The force required to remove the basketball B from its engagement with the cap 24 will be proportionate to the pressure within the cap 24. In order to vary this pressure, the rheostat 38 can be adjusted to operate the motor for the vacuum pump faster or more slowly to provide greater or less vacuum, or the valve 39 can be adjusted. With proper adjustment of the rheostat 38 and/or valve 39 basketball B can adhere so strongly that one must grasp the ball with both hands in order to pull the ball loose from the cap 24; or rheostat 38 may be adjusted so that a mere touching, or tipping, of the ball B will cause it to come loose from the cap 24.

It will now be seen that the boom 10 can be pivoted about the post 11 as an axis, thereby placing the down-turned section 12 and the depending extendible section 14 at any desired angle with respect to the backboard 15. Thus, by simply swinging the boom 10, the cap 24 can be moved in a horizontal plane to be in virtually any desired position. Similarly, by releasing the cable 30, or drawing up the cable 30, the cap 24 can be raised or lowered, moving the ball B in a vertical plane for virtually any desired vertical position. With the combination of these two motions, it will be seen that the basketball can be placed and held in any selected position to simulate a basketball that has bounced from the backboard, or the goal itself, at any desired angle. Additionally, with the variation of the vacuum within the cap 24, thereby varying the holding force, a player can be required to exercise any degree of force desirable in order to remove the ball from the cap 24.

Figure 3:
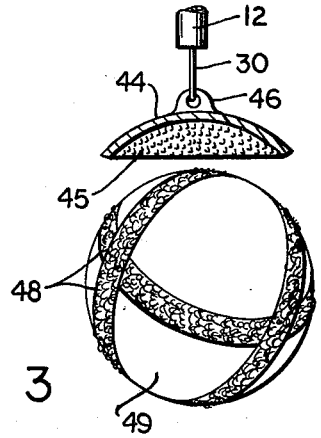
FIG. 3 is a cross-sectional view showing a modified form of holding means and attaching means for the basketball; and, FIG. 4 is a cross-sectional view showing a second modified form of holding means for the basketball.
Figure 2:
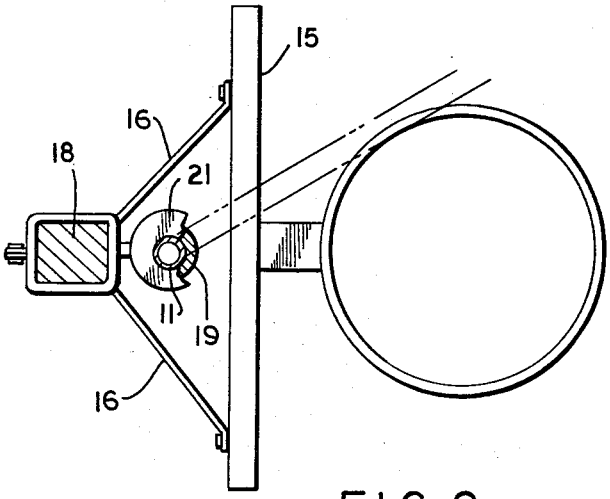
FIG. 2 is a cross-sectional view taken substantially along the line 2—2 in FIG. 1.

Referring now to FIG. 3 of the drawing, a modified form of holding and attaching means for the ball B is shown. In this embodiment of the invention, the cap 44 is lined with hooks 45 of a hook and teazle material, commonly known under the trademark "Velcro". The cap 44 comprises simply a sector of a sphere having a tab 46 on the upper surface thereof for attachment of the cable 30. It will be understood that the cable 30, as in previously described embodiments, passes through the down-turned portion 12, and through the boom 10 as previously described.

To cooperate with the hooks 45, the teazle 48 is fixed to the basketball 49. In order to prevent enlarging a portion of the basketball 49, the teazle material 48 should be inlaid into the surface of the ball; and, it should be understood that the teazle 48 can be placed in the ball in relatively narrow strips to provide sufficient holding force between the hooks and the teazle 48 to operate satisfactorily as the attaching means in the present invention.

Figure 4:
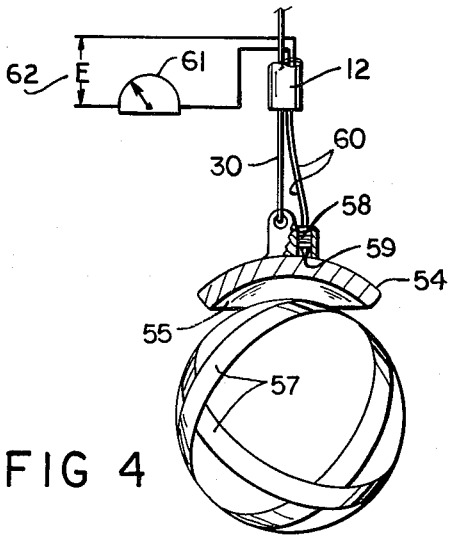

Attention is next directed to FIG. 4 of the drawing which discloses another modification of the releasable holding means for the ball. In FIG. 4, the cap designated at 54 may be made of soft iron or other ferromagnetic material. The interior 55 of the cap 54 is formed as a segment of a sphere so that a basketball 56 will fit into the cap 54 and be contiguous with the interior 55.

Above the cap 54 it will be seen that an electromagnet 58 is provided, the electromagnet 58 being here shown simply as a coil of wire having a core 59 which engages the cap 54. An electric cord 60 leads from the coil 58 and into the down-turned portion 12. In FIG. 4, there is a schematic showing of the electrical connection for the cord 58, and it will be seen that the connection would include a potentiometer 61, and a source of electrical power 62.

It will therefore be seen that, with the source of electrical power 62 connected to the coil 58 through the potentiometer 61, with the wiper of the potentiometer 61 moved to its extreme position, the coil 58 will have maximum current to provide a maximum magnetic force for the cap 54. Conversely, the wiper of the potentiometer 61 can be moved in the opposite direction to reduce the current to the coil 58 and thereby reduce the magnetic force of the cap 54.

For use with the cap 54, the basketball 56 would include an inlaid sheet, or inlaid strips 57, of ferromagnetic material. This can include a filled plastic material or any other material desired so long as the material has the necessary ferromagnetic characteristics.

It will therefore be seen that, with the embodiment of the device shown in FIG. 4 of the drawing, the potentiometer 61 can be adjusted so that the holding force of the cap 54 will require considerable force to remove the ball 56 from the cap 54; or, the potentiometer 61 can be adjusted so that the ball 56 can be very easily removed from the cap 54 to allow practice tipping and the like.

From the foregoing description, the operation of the device should now be understandable. When a coach wishes to have his players practice rebounding or tipping, the boom 10 would be placed at the desired angle with respect to the background 15 by urging the boom 10 to rotate about the pipe 11. It is contemplated that the lower surface of the washer 21 and the upper surface of the sleeve 19 will be arranged to provide sufficient frictional force that the boom 10 will not inadvertently move to any great extent. If necessary, the lower surface of the washer 21 and the upper surface of the sleeve 19 can be slightly roughened and knurled to increase the frictional holding force.

After the boom is placed at the desired angle with respect to the backboard 15, the cable 30 would be adjusted to raise or lower the cap 24 to place the ball B at the desired height. At this point the vacuum motor would be energized so that the vacuum pump would evacuate the interior of the boom, hence the cap 24, and a basketball B can be thrown against the cap where the ball will stick. The rheostat 38 can be adjusted to provide the desired amount of holding force for the particular practice.

It will now be understood that one or more of the players can be instructed to reach for the ball as if the ball had just bounced from the backboard 15, and either one player can reach for the ball, or several players can reach for the ball to simulate playing conditions. Each time the ball B is pulled from the cap 24, the coach can simply throw the ball against the cap 24 and it will again stick to the cap and be ready for the next exercise.

When the players have practiced taking the ball from a particular location, the coach can adjust the angle of the boom 10 and/or adjust the height of the ball B so that the position of the ball simulates bouncing from the backboard 15 at a different angle. At any time, the rheostat 38 can be adjusted so that the force required to remove the ball B from the cap 23 is varied so that the coach can simulate different conditions and different forms of play with sureness and with repeatability.

While use of the device has been discussed in conjunction with the embodiment shown in FIG. 1 of the drawing, it will be understood that the motions of the boom and of the cap 44 or 54 would be the same. Also, in the embodiment shown in FIG. 4 of the drawing, rather than adjusting the rheostat 38 to vary the vacuum within the cap 24, one would adjust the potentiometer 61 to vary the magnetic field in the cap 54 to achieve the same result, or in other equivalent forms one would adjust whatever other form of attaching means may secure the ball to the cap.

It will therefore be seen that the present invention provides means for releasably holding a basketball at any desired position with respect to the backboard and goal; and, the holding force can be varied to any desired extent. Thus, any form of practice can be simulated.

When the practice is over and the players are to play a game, the boom 10 can simply be swung sufficiently to place the cap 24 rearwardly of the backboard 15 so that the cap 24 will be completely out of the basketball court. The apparatus of the present invention will then be completely out of the way for the basketball court to be used as normal.

In the game of basketball presently, the goal is ten feet from the floor. With this distance, the apparatus of the present invention can be designed to hold the ball a maximum of twelve feet from the floor and a minimum of nine feet from the floor. While greater and less distances may be used as desired, these limits will serve most of the desirable forms of practice and minimize the lengthening requirements for the extendible section 14.

It will of course be understood by those skilled in the art that the particular apparatus here shown is by way of illustration only, and is meant to be in no way restrictive; therefore, numerous changes and modifications may be made, and the full use of equivalents resorted to, without departing from the spirit or scope of the invention as defined by the appended claims.

I claim:

1. A basketball practice device, wherein at least one player can practice techniques for handling a basketball relatively to a backboard and a goal, said practice device comprising holding means for releasably holding said basketball adjacent to said backboard and said goal, said holding means being so constructed and arranged that said basketball is removable from said holding means by a player through the use of a predetermined amount of force, support means for supporting said holding means, said support means being movable with respect to said backboard, said support means including extendible means carrying said holding means, said extendible means providing for selected movement of said holding means in a vertical plane, said holding means including a cap, and attaching means for releasably attaching said basketball to said cap, said support means comprising a boom, said extendible means being carried by one end of said boom, and pivot means for pivotally mounting said boom above said backboard.

2. A practice device as claimed in claim 1, said attaching means comprising loop and teazle material, said loop material being fixed to the interior of said cap, said teazle material being fixed to said basketball.

3. A practice device as claimed in claim 1, said attaching means comprising means for magnetizing said cap, and ferromagnetic material fixed to said basketball, and means for varying the magnetic force of said cap.

4. A basketball practice device, wherein at least one player can practice techniques for handling a basketball relatively to a backboard and a goal, said practice device comprising holding means for releasably holding said basketball adjacent to said backboard and said goal, said holding means being so constructed and arranged that said basketball is removable from said holding means by a player through the use of a predetermined amount of force, support means for supporting said holding means, said support means being movable with respect to said backboard, said support means including extendible means carrying said holding means, said extendible means providing for selected movement of said holding means in a vertical plane, said holding means including a cap, and attaching means for releasably attaching said basketball to said cap, said attaching means including means for evacuating said cap, and sealing means for sealing between said basketball and said cap when said basketball has said cap received thereon, said means for evacuating said cap including a source of vacuum in communication with said cap, and means for varying said source of vacuum, said support means comprising a boom pivotally mounted above said backboard, said extendible means being carried by one end of said boom and placed in the vicinity of said goal, said extendible means including a tubular member fixed to said cap, said boom having an opening therethrough in communication with the opening in said tubular member, a vacuum pump carried by said boom, the low pressure side of said vacuum pump being connected to said opening through said boom, a motor connected to said vacuum pump for driving said vacuum pump, and a housing surrounding said vacuum pump and said motor, and a cable connected to said cap and extending through said tubular member and said opening through said boom.

* * * * *